US005669082A

United States Patent [19]

Sun

[11] Patent Number: 5,669,082

[45] Date of Patent: Sep. 23, 1997

[54] FLUSH CONTROL DEVICE FOR TOILET

[76] Inventor: Feng-Chi Sun, 5F, No. 3, Alley 3, Lane 60 Chao-Chow Street, Ta-An District, Taipei City, Taiwan

[21] Appl. No.: 659,298

[22] Filed: Jun. 6, 1996

[51] Int. Cl.[6] ..... E03D 1/14

[52] U.S. Cl. ..... 4/325; 4/324; 4/378

[58] Field of Search ..... 4/325, 324, 378, 4/379, 381, 382

[56] References Cited

U.S. PATENT DOCUMENTS 1,397,208 11/1921 Griffiths ..... 4/382

4,232,408 11/1980 Chen-Yuan ..... 4/325

4,296,505 10/1981 Chien-Sheng ..... 4/324

*Primary Examiner*—David J. Walczak

[57] ABSTRACT

A flush control device for toilet comprises a water discharging member, a control member and a stepped check member disposed at their relative position in a water tank. The stepped check member is composed of a plurality of damper plates in different size and co-axially engaged in a lug means adjacent a water outlet. The damper plates each has a first shoulder of different heights at their front sides toward a outlet valve. So that the damper plates rotate in accordance with the variation of the water level in the tank to check the outlet valve to open a different span so as to discharge a selective amount of flush water into a toilet bowl.

8 Claims, 11 Drawing Sheets

FIG 5C
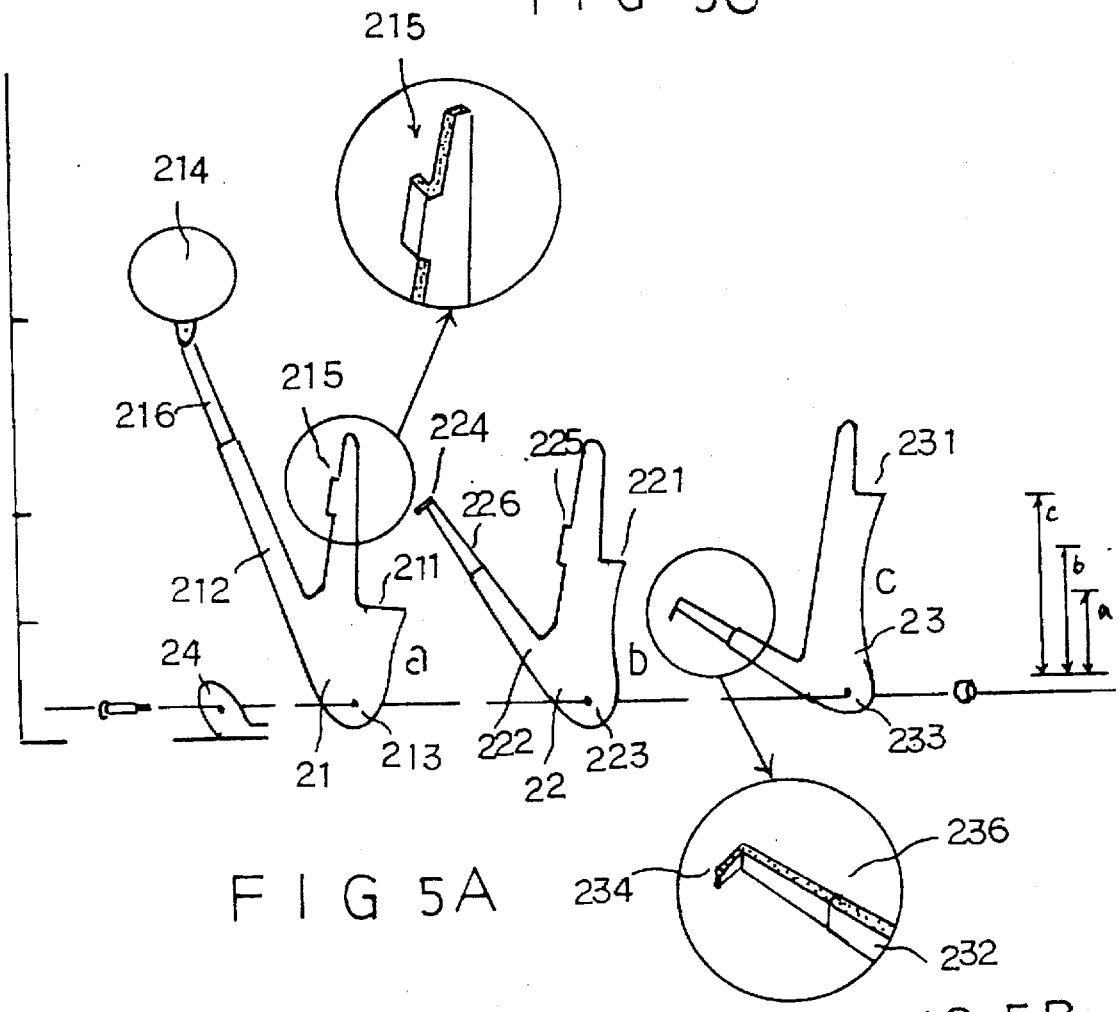
FIG 5A
FIG 5B
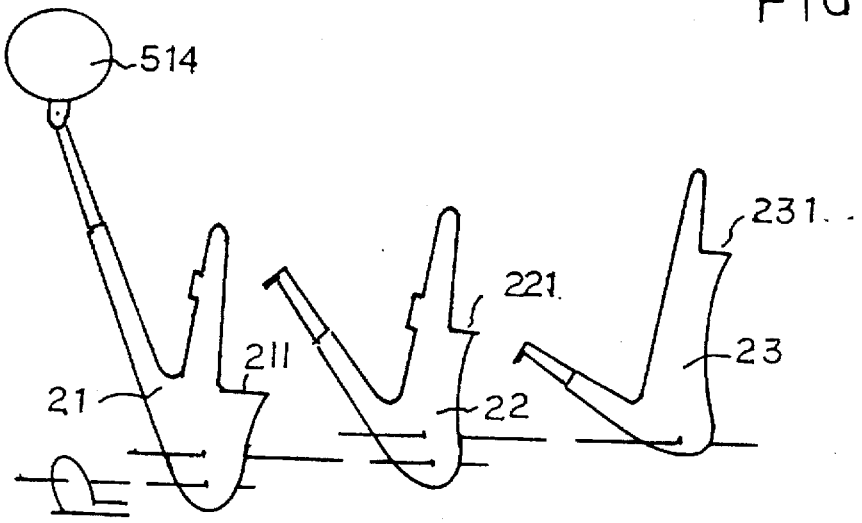
FIG 6

FLUSH CONTROL DEVICE FOR TOILET

BACKGROUND OF THE INVENTION

The present invention relates to water discharge control devices and more particularly to a control device adaptable to a toilet which device can be selectively controlled to discharge maximum or minimum amount of flush water from a water tank.

It is known that a toilet must flush after excretion in order to maintain the toilet bowl to be clean and sanitary. This is a daily routing for humen in modern society. Conventional toilets old or new, have their common disadvantage such that every time when the flush device is actuated, a tankful of water is discharged totally regardless whether such large amount of water is needed. In many occasions, a small amount of flush water is sufficient. To discharge such a large amount of water is but as a consequence of wasting water resource. Since the discharge of a small amount of flush water is frequent than that of a large amount of flush water.

SUMMARY OF THE PRESENT INVENTION

The present invention has a main object to provide a flush control device for toilet which can provide a large amount of flush water or a selective small amount of flush water to cope with the certain requirement of the users for obtaining the water saving purpose.

Another object of the present invention is to provide a flush control device for toilet which is adaptable to replace part of the existing flush device in a toilet to renew the overall function of the toilet.

Still another object of the present invention is to provide a flush control device for toilet which has a simple structure for facilitating a ready use and inexpensive to manufacture.

Accordingly, the flush control device of the present invention comprises generally a selectively controlled check member which utilizes the variation of the water level in the tank and is actuated by the water flow to selectively check the outlet valve from closing the water outlet so as to discharge selective amount of flush water into the bowl.

The present invention will become more fully understood by reference to the following detailed description thereof when read in conjunction with the attached drawings.

BRIEF DESCRIPTION OF THE DRAWINGS

FIGS. 5A to 5C are the diagrams to show a set of damper plates being axially pivoted, FIG. 6 is an exploded view to show the set of damper plates being alternately pivoted.

DETAILED DESCRIPTION OF THE PREFERRED EMBODIMENT

Figure 1:
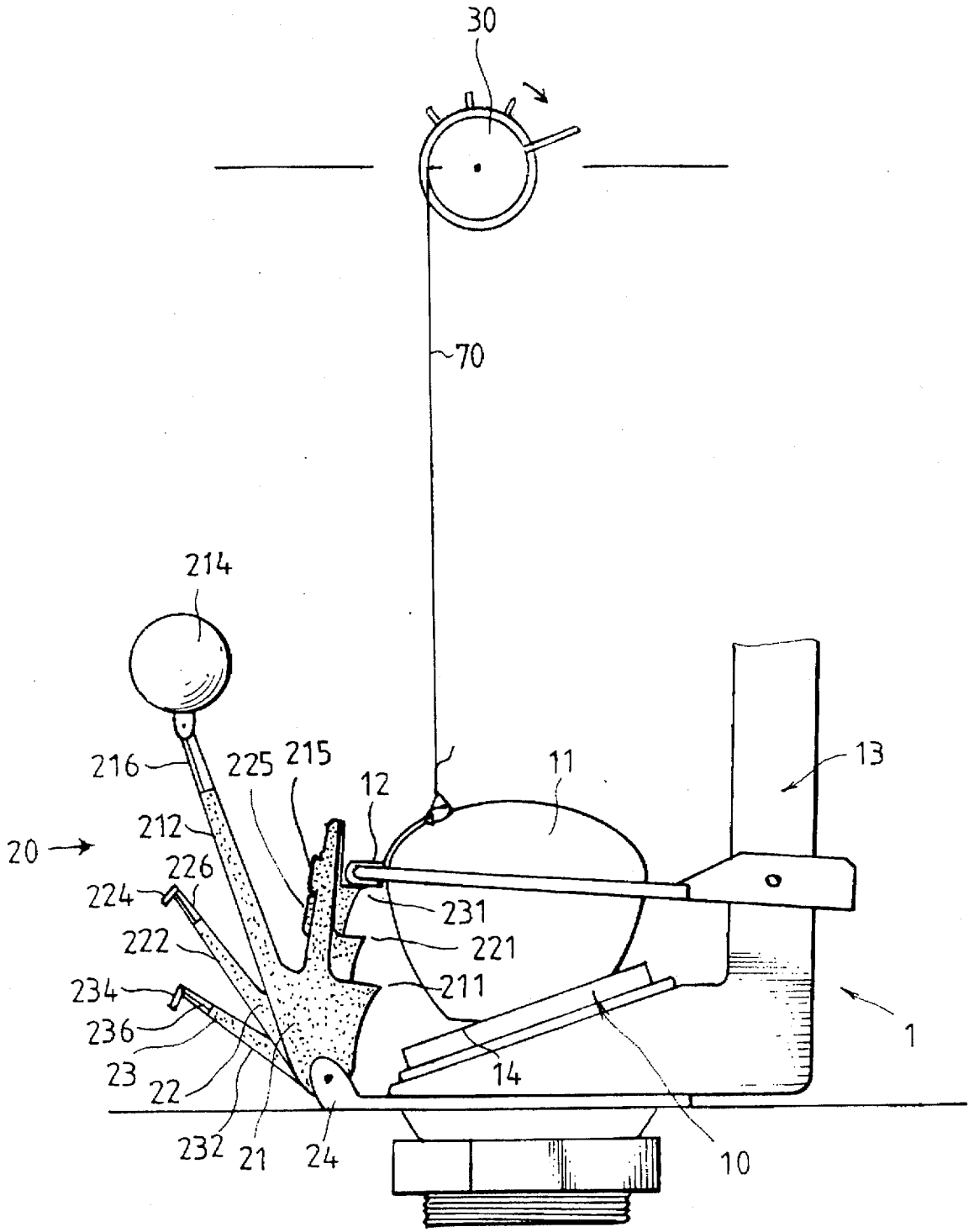
FIG. 1 is a perspective view to show a three stepped control device of the present invention.

With reference to FIG. 1 of the drawings, the flush control device of the present invention comprises a water discharging member 10, a stepped check member 20 and a control member 30.

Figure 3:
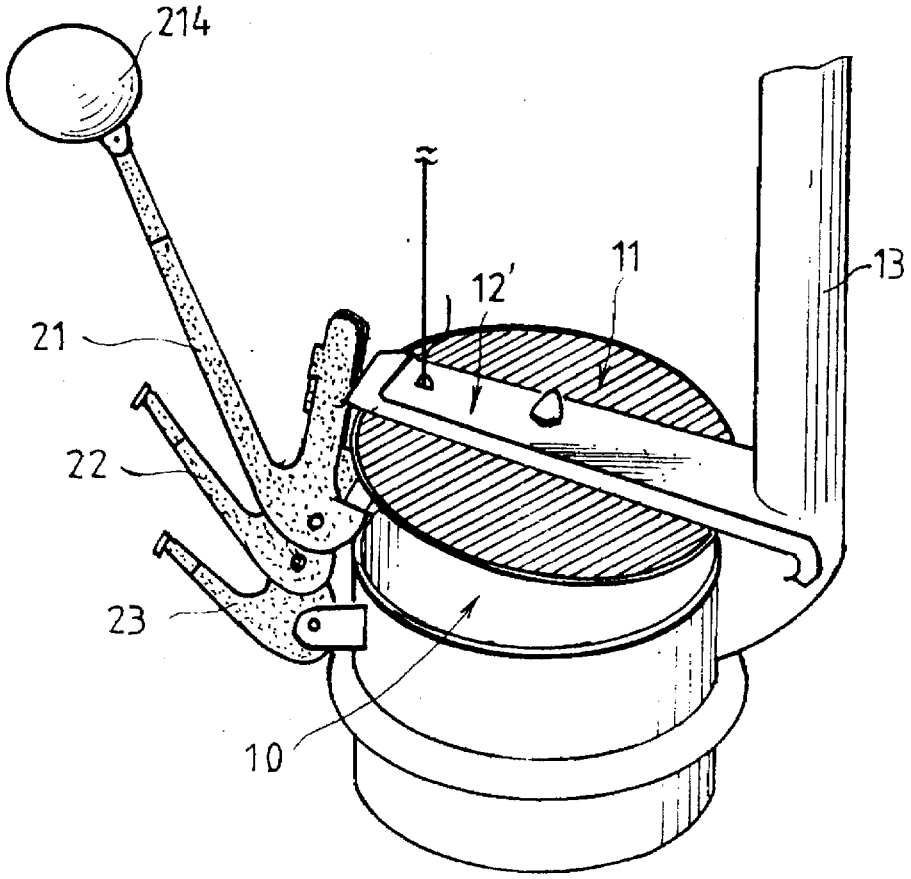
FIG. 3 is a perspective view to show another pivoting manner of the control device of FIG. 2.
Figure 4:
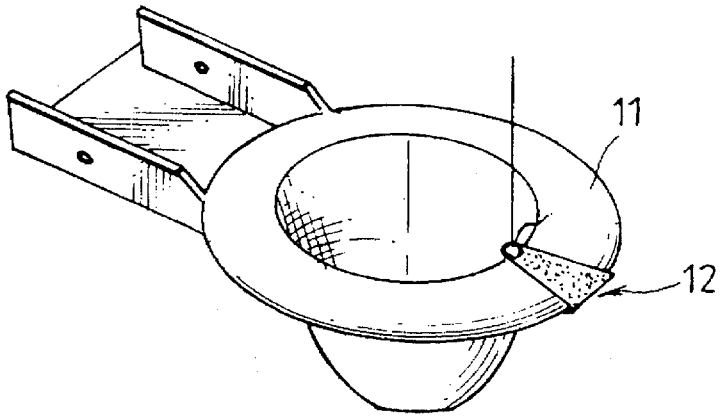
FIG. 4 is a perspective view to show an outlet valve and a rigid flap means.

The water discharging member 10 comprises a outlet valve 11 pivoted to an overflow pipe 13 and a water outlet 14 below the outlet valve 11 and through the bottom of the water tank 1. The outlet valve 11 can be varied as show in FIGS. 2 and 3. A rigid flap means 12 of a U-shaped section is reinforced at a forward circumference of the outlet valve 11 (as shown in FIG. 4).

Figure 2:
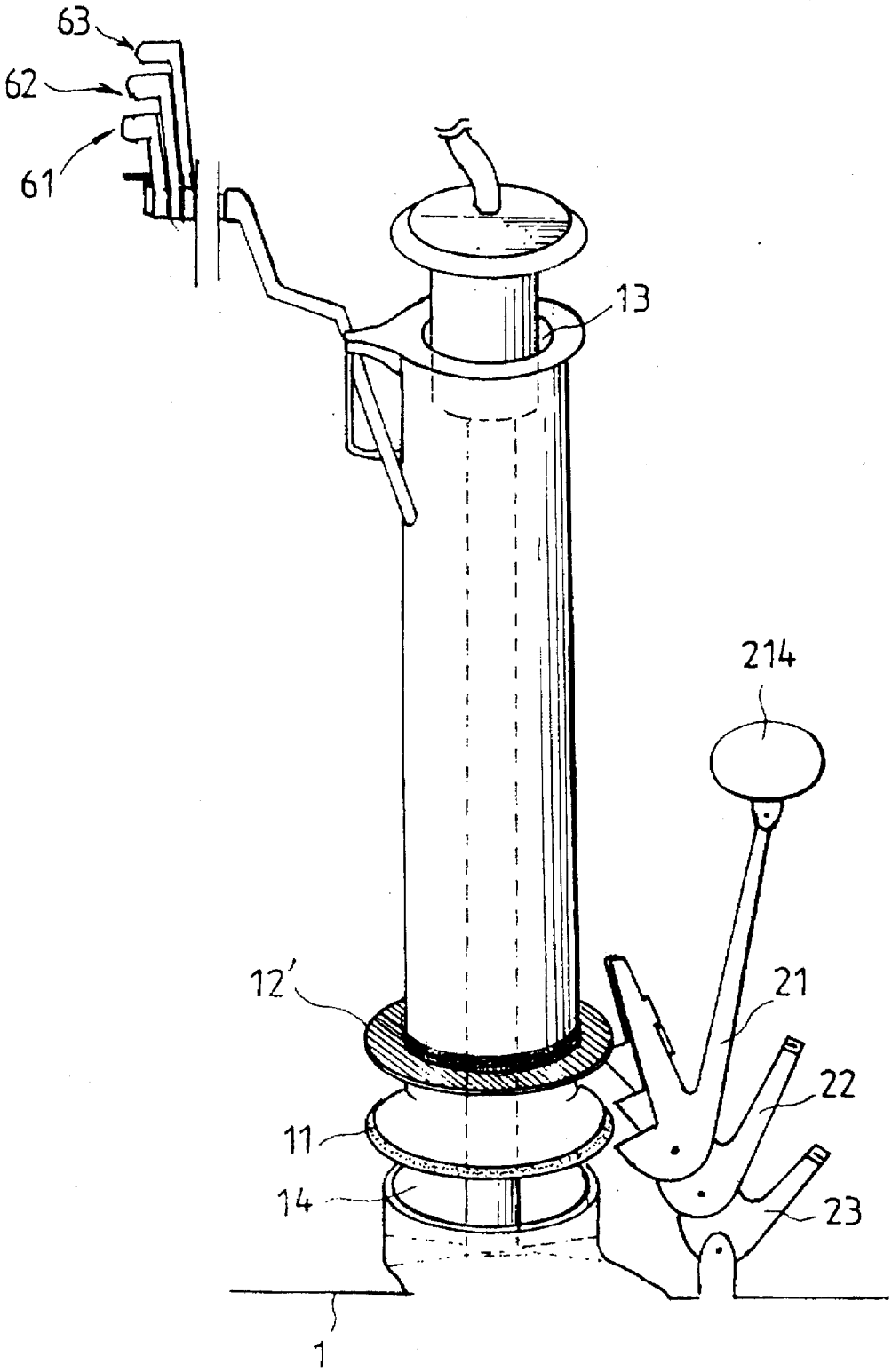
FIG. 2 is a perspective view to show the control device of FIG. 1 which is jaxtaposedly arranged in the form of a mackerel sky.
Figure 18:
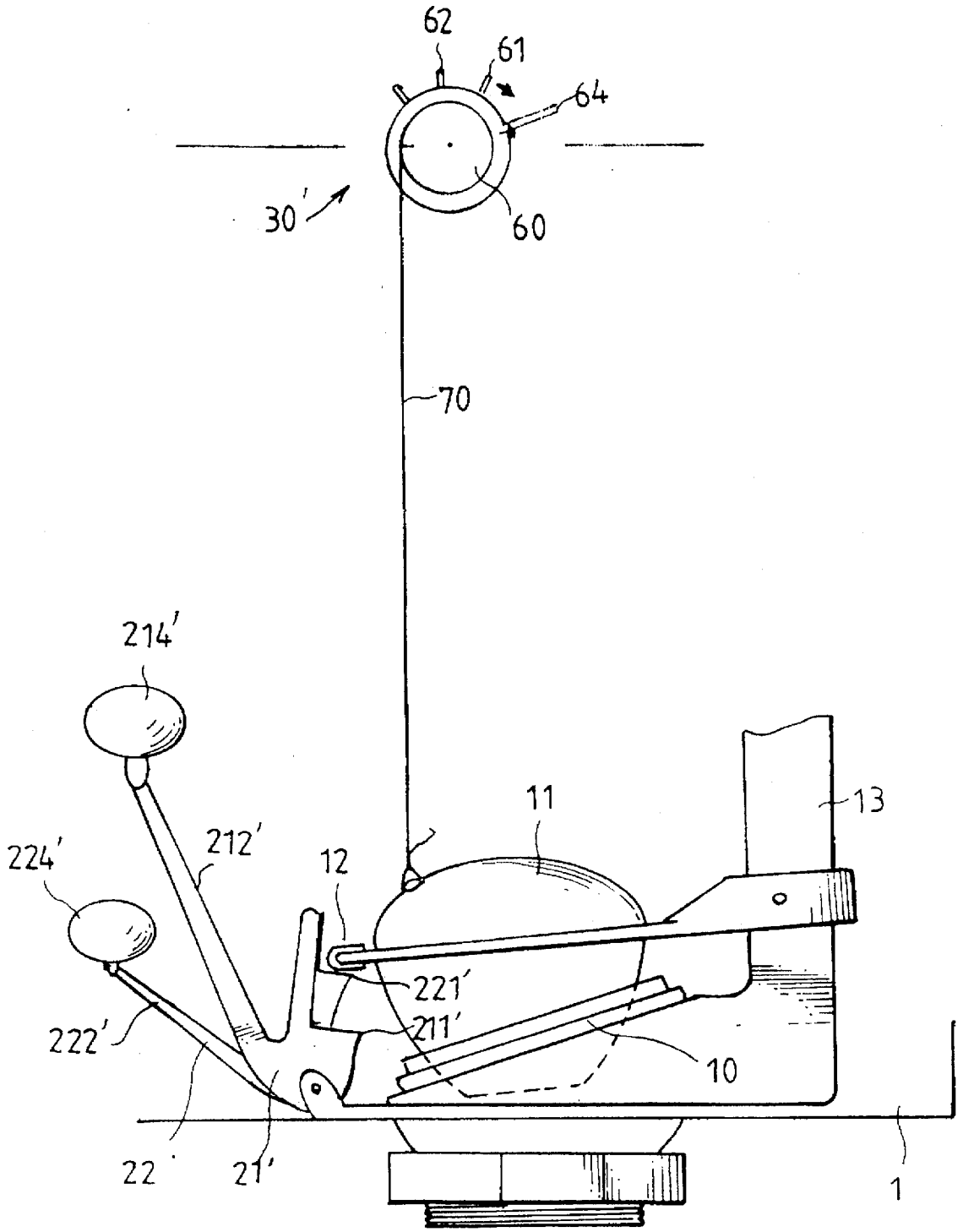
FIG. 18 is a perspective view to show a two stepped flush control device engaged with a pair of float halls.

The stepped check member 20 is composed of a first, second and third damper plates 21, 22 and 23 (as shown in FIGS. 5A to 5C), each has a first shoulder 211, 221 and 231 at a front portion, an elongate tail 212, 222 and 232 slantly extended upward from a rear portion thereof and a thru hole 213, 223 and 233 laterally formed adjacent the lower end for co-axially pivoting those damper plates 21, 22 and 23 into a lug means 24 at the bottom of the water tank 1 (as shown in FIGS. 5A to 5C). The damper plates 21, 22 and 23 have their shoulders at different heights so as to define three steps toward the outlet 14. The damper plates 21, 22 and 23 can be alternately pivoted together into a mackerel sky form (as shown in FIGS. 2 and 6). The way is that first pivotally connects the thru hole 213 of the first damper plate 21 to a medial portion of the second damper plate 22, then connects the thru hole 223 of the second damper plate 22 to a medial portion of the third damper plate 23 and then pivotally connects the thru hole 233 into the lug means 24, so that the damper plates 21, 22 and 23 can be pivoted individually. The upper ends of the elongate tails 212, 222 and 232 of the damper plates 21, 22 and 23 are positioned at different water levels such that the upper end of tail 212 is positioned at a high water level, the upper end of tail 222 is positioned at a medium water level and the upper end of the tail 232 is positioned at a low water level. A float ball 214 pivotally secures to the upper end of the elongate tail 212 of the first damper plate 21 and the upper ends of the elongate tails 222 and 232 of the second and third damper plates 22 and 23 each has a transverse portion 224 and 234. The first and second damper plates 21 and 22 each has a second shoulder 215 and 225 in rectangular form and extended to a lateral side of the plates 21 and 22, integrated on a rear portion in different elevations with the shoulder 215 which is higher than the shoulder 225. When the float ball 214 is moving up or downward along the variation of the water level, the transverse portions 224 and 234 and the second shoulder 215 and 225 will be rotated forward or backward in cooperation with the float ball 214 to check the outlet valve 11 from further downward movement. Alternately, the upper ends of each elongate tails 212, 222 and 232 can pivotally connect with a float ball 214 (as shown in FIG. 18) or that each tails 212, 222 and 232 can be connected with an extension 216, 226 and 236 (as shown in FIG. 5B).

Figure 7:
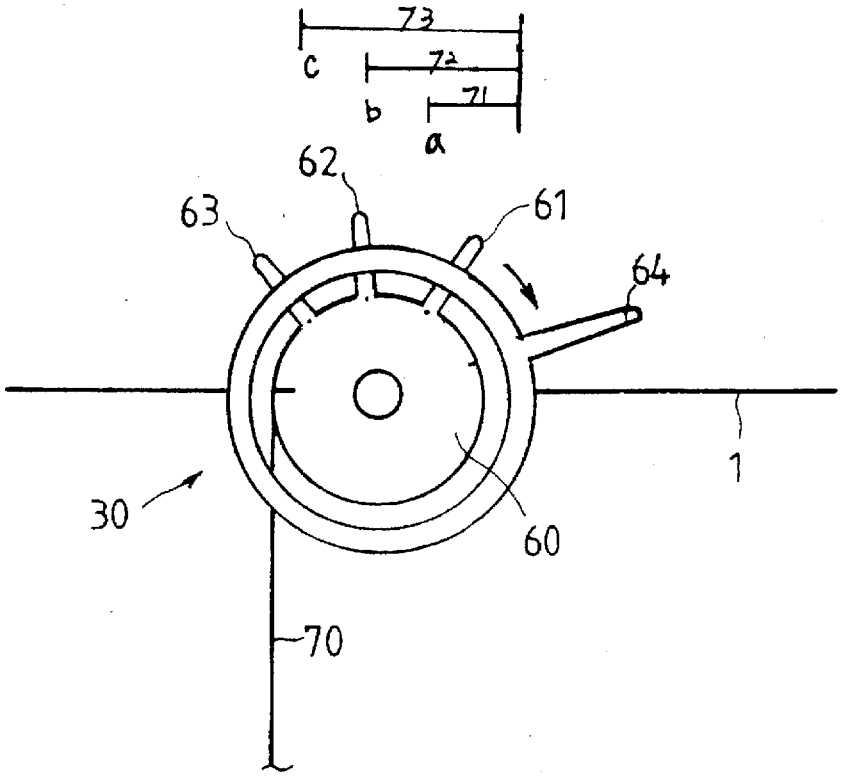
FIG. 7 is a top view to show a control member of the present invention.
Figure 8:
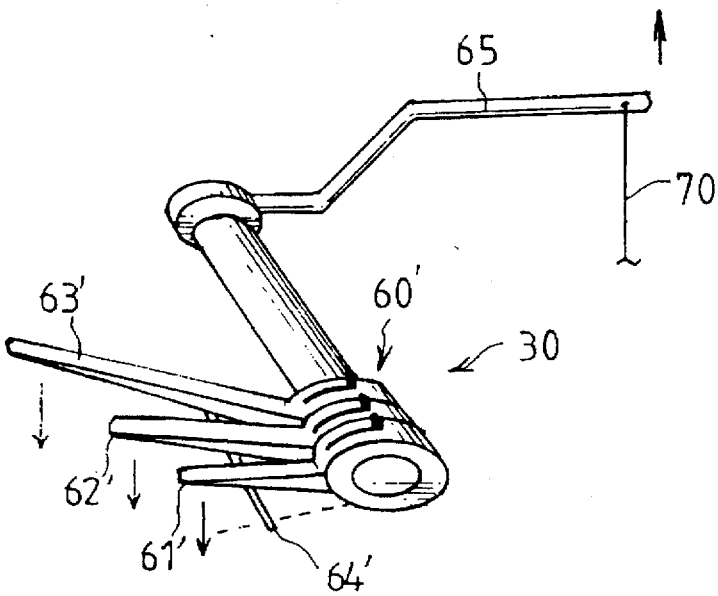
FIG. 8 is an alternative structure the control member.

The control member 30 (as shown in FIG. 1) is rotatably secured to the upper portion of the water tank 1 and connected with the outlet valve 11 via a soft wire 70 therebetween. The control member 30 can be configured into two configurations (as shown in FIGS. 7 and 8), a first configuration is a wheel 60 on which the soft wire 70 is wound and has a first, second and third positioning rods 61, 62 and 63 and a stopping rod 64 spacedly extended outward from a lateral periphery. The interval 71 between the first positioning rod 61 and the stopping rod 64 equals the height a of the shoulder 211, the interval 72 between the second positioning rod 62 and the stopping rod 64 equals to the height b of the shoulder 221 and the interval 73 between the third positioning rod 63 and the stopping rod 64 equals to the height c of the shoulder 231 (as shown in FIGS. 5A to 5C). A second configuration is an axle shaft 60' which has a suspension rod 65 secured to the free end thereof for suspending the soft wire 70 therefrom, a first, second and third positioning rods 61', 62' and 63' rotatably and co-axially secured to the other end thereof and a stopping rod 64' perpendicularly connected to an under side of the third positioning rod 63'. The intervals 71, 72 and 73 between the positioning rods 61', 62' and 63' and the stopping rod 64' are similar to those that recited in the first configuration 60 and their functions will set forth in the following operation modes. However, the positioning rods 61', 62' and 63' are rotatably adjustable and affixed on the shaft by a latch pins.

The operation modes of this invention includes the use of one float ball 214 actuating the transverse portion and the second shoulder 215 and 225 of other damper plates to perform two stepped or three stepped discharge of selective flush water, and use of two float balls actuating its own damper plates to perform two stepped discharge of selective flush water.

Figure 9:
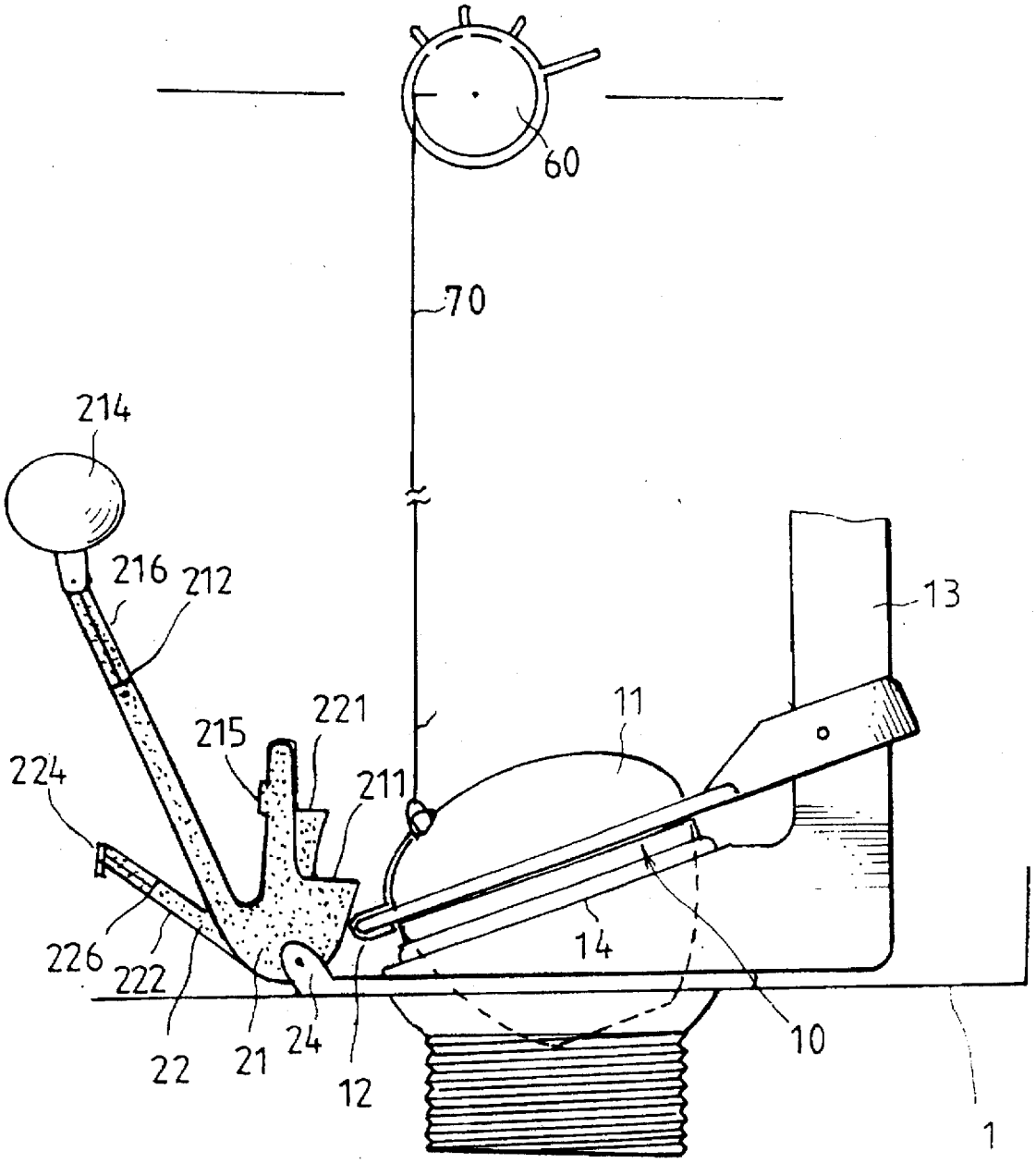
FIG. 9 is a perspective view to show a two stepped discharging device of the present invention.
Figure 10:
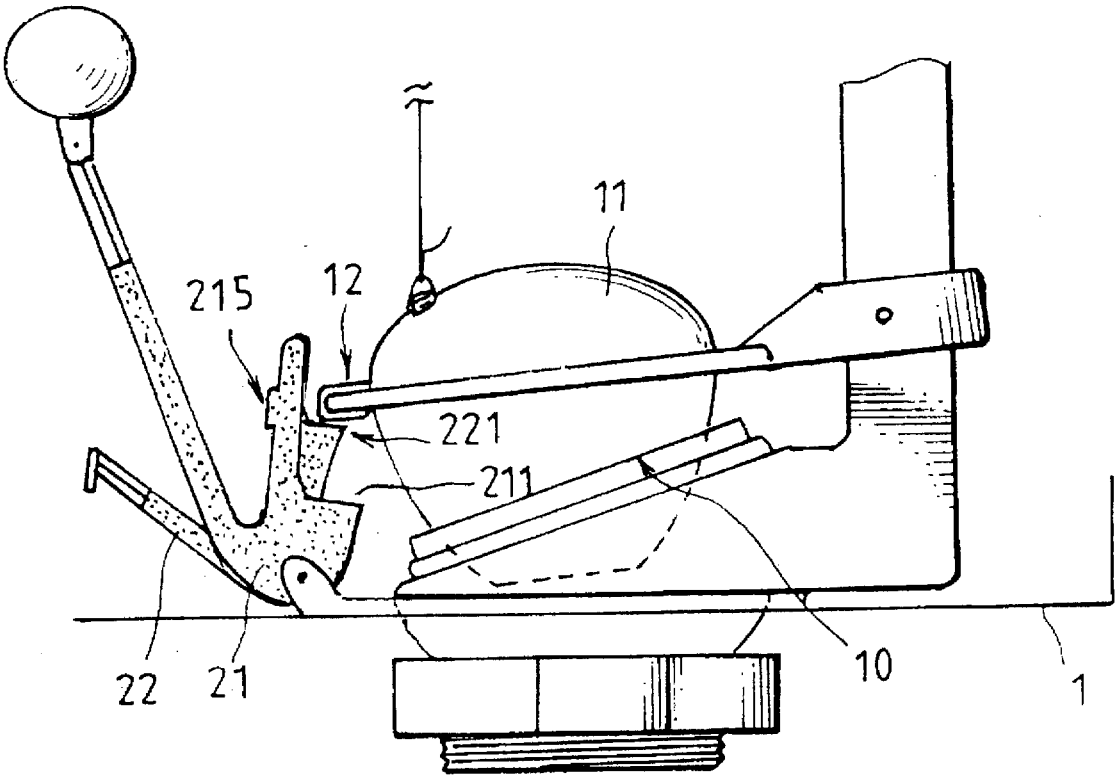
FIG. 10 is a perspective view to show the device of FIG. 9 discharging a large amount of flush water.
Figure 11:
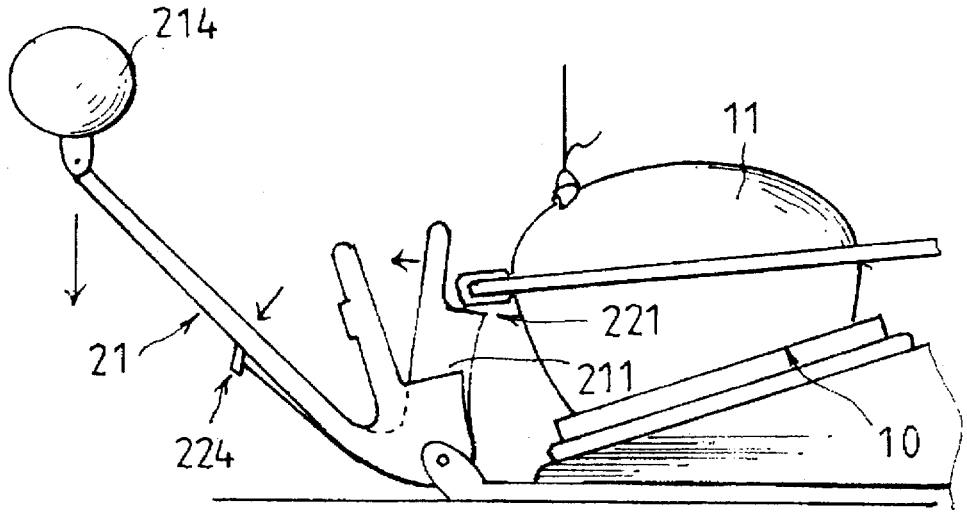
FIG. 11 is a perspective view to show the second damper plate being actuated by the first damper plate to disengage with the outlet valve.

Referring to FIGS. 2 and 9, which show a first operation mode in which the first and second damper plates 21 and 22 are adapted to axially pivoted into the lug means 24. When the water in the tank reached to a high level, the buoyancy of the float ball 214 actuates the first damper plate 21 rotating forward and the second shoulder 215 of the first damper plate 21 actuates the second damper plate 22 rotating forward in concert with the first damper plate 21 and thus the front sides of the first shoulders 211 and 221 are together stopped against the upper portion of the rigid flap means 12 of the outlet valve 11 so as to close the water outlet 14. If one wants to discharge a medium amount of flush water, rotate the wheel 60 and affix the positioning rod 62 to the stopping rod 64 so as to lift the outlet valve 11 opening to a span equal to the height b and the first damper plate 21 in cooperation with the second shoulder 215 actuate the second damper plate 22 to move together further forward that the rigid flap means 12 of the outlet valve 11 is then stopped against the upper surface of the first shoulder 221 of the second damper plate 22 (as shown in FIG. 10) therefore permitting a smooth discharge of a medium amount of flush water into the toilet bowl. When the water in the tank is reached to a lower limit, the float ball 214 will drop downward with the water flow and actuates the transverse portion 224 of the second damper plate 22 moving downward to leverly disengage the first shoulder 221 with the rigid flap means 12 (as shown in FIG. 11) and simultaneously, the soft wire 70 is rewound to permit the outlet valve 11 dropping down to automatically close the water outlet 14 on its own weight for recruiting the water into the tank 1.

Figure 12:
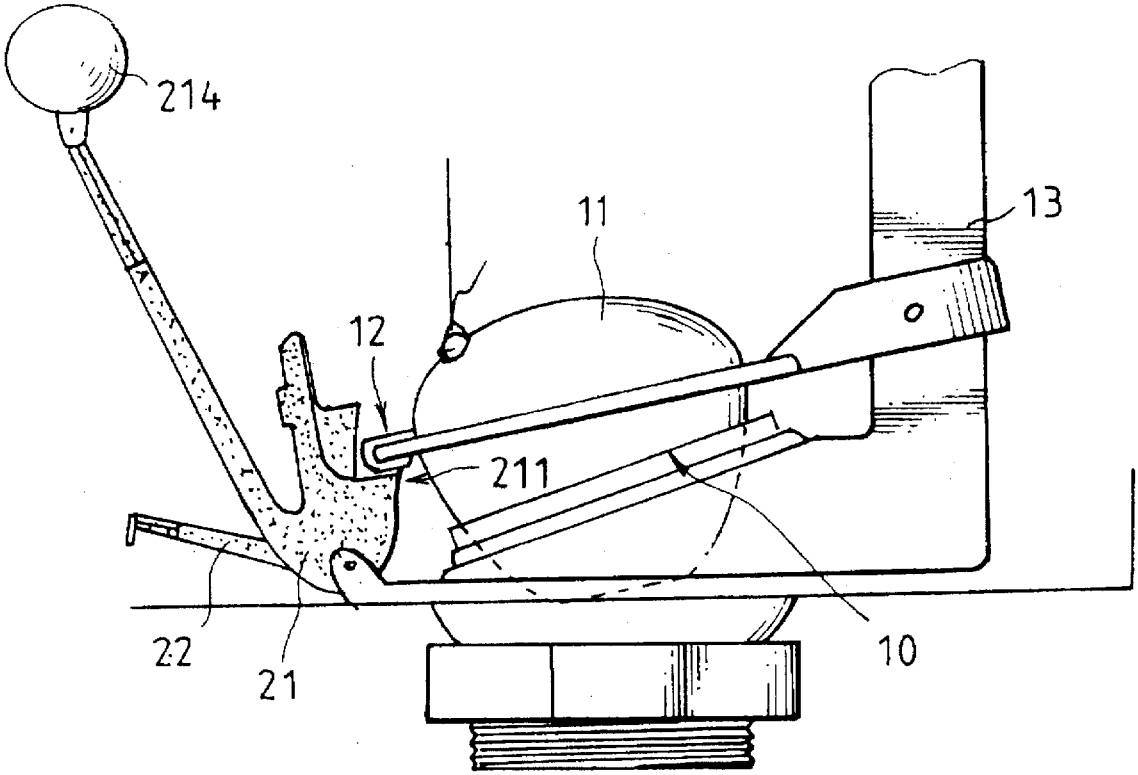
FIG. 12 is a perspective view to show the device of FIG. 9 discharging a small amount of flush water.
Figure 13:
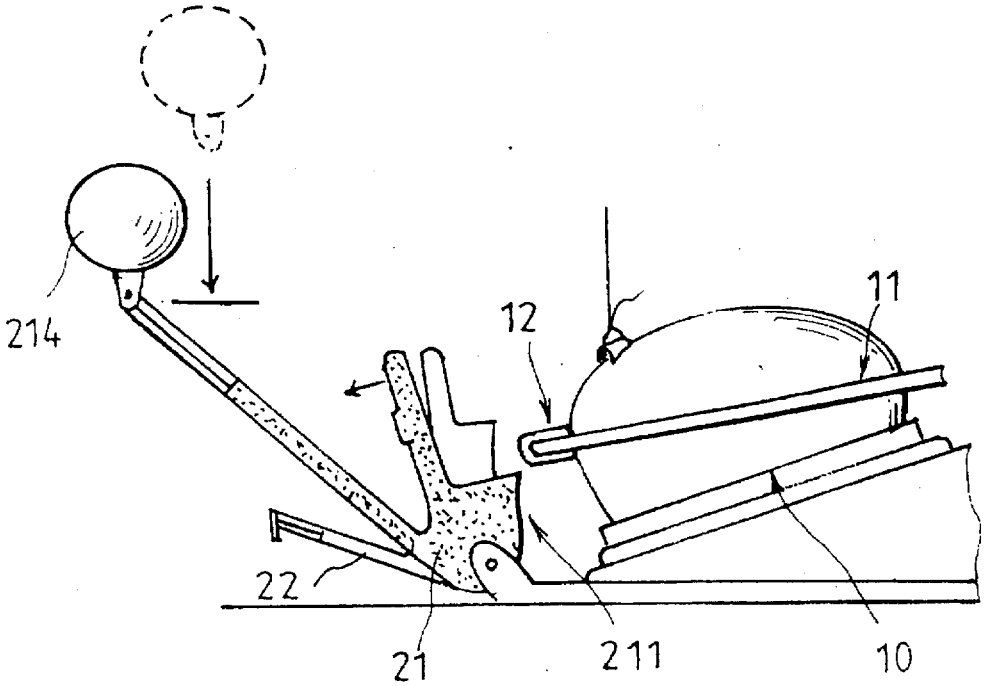
FIG. 13 is a perspective view to show the disengagement of a first shoulder with the outlet valve.

If discharging a minimum amount of flush water, affix the positioning rod 61 to the stopping rod 64 and the outlet valve 11 is lifted to open to a span equal to the height a. Meanwhile, the first damper plate 21 actuated by the buoyancy of the float ball 214 moving forward toward the outlet valve 11 to permit the first shoulder 211 thereof stopped against the under side of the rigid flap seams 12 of the outlet valve 11 (as shown in FIG. 12) so as to allow a minimum amount of flush water to be discharged therethrough. When the water in the tank 1 reached to a lower limit (as shown in FIG. 13), the float ball 214, for loss of buoyancy, drops downward to leverly actuate the first damper plate 21 to disengage the first shoulder 211 with the rigid flap seans 12. So that the outlet valve 11 automatically drops down to close the water outlet 14 on its own weight.

To perform the three stepped discharge of selective amount of flush water is to axially pivot the first, second and third damper plates 21, 22 and 23 together into the lug means 24 (as shown in FIG. 1).

Figure 14:
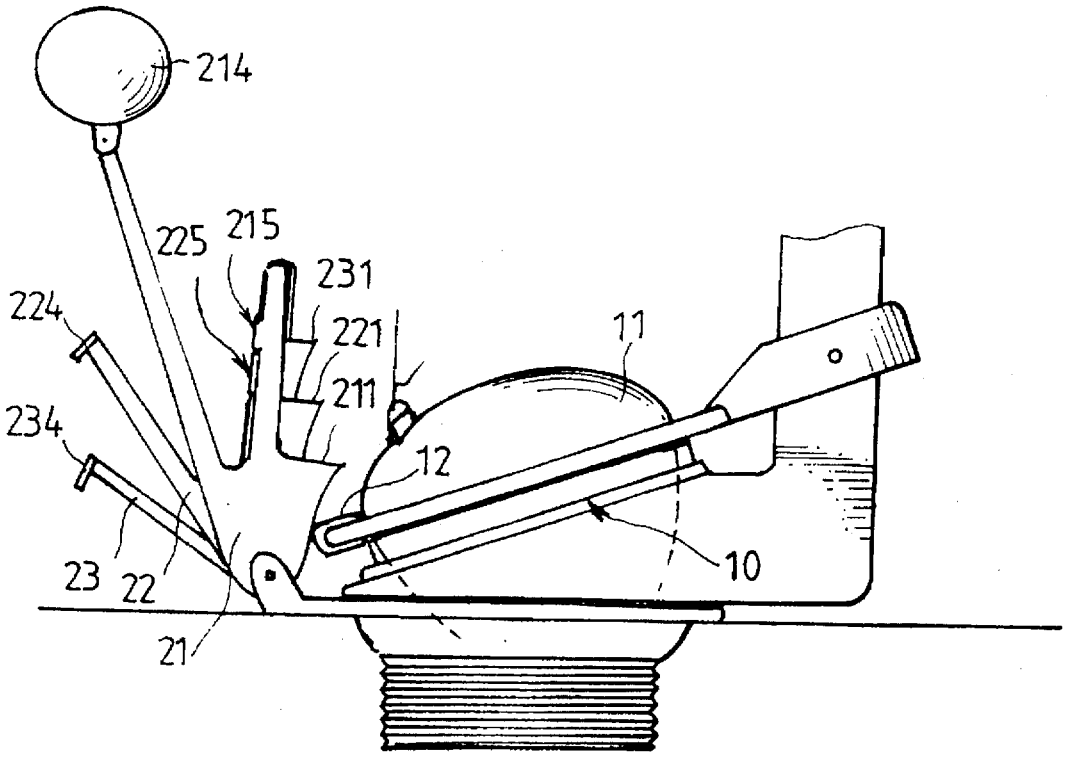
FIG. 14 is a perspective view to show a three stepped flush control device when the outlet valve is in closed position.
Figure 15:
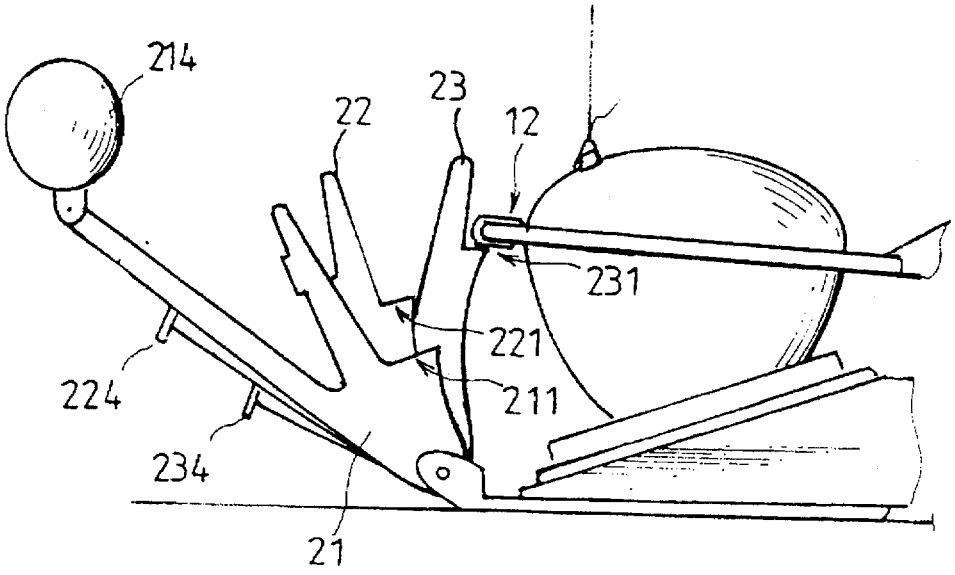
FIG. 15 is a perspective view to show the three stepped flush control device discharging a maximus amount of flush water.

Referring to FIGS. 14 to 17 of the drawings, when the water in the tank 1 is at high level, the first shoulders 211, 221 and 231 of the three damper plates 21, 22 and 23 are jaxtaposed and stopped against the top of the rigid flap means 12 and the outlet valve 11 closes the water outlet 14 (as shown in FIG. 14). If discharge a maximum amount of flush water, it is to rotate the wheel 60 of the control member 30 and shifts the positioning rod 63 to the stopping rod 64, then the outlet valve 11 is lifted to open a span 73 equal to the height c which is the height of the first shoulder 231 of the third damper plate 23. Meanwhile, the float ball 214 under buoyancy forces the three damper plates 21, 22 and 23 moving more forward to have the first shoulder 231 simultaneously stopped against the under side of the rigid flap means 12 so as to permit a smooth discharge of a maximum amount of flush water from the tank 1. When the water level in the tank 1 begins to drop, the first damper plate 21 actuated by the float ball 214 will first disengage with the second damper plate 22 and press the transverse portion 224 of the second damper plate 22 moving downward to force the second damper plate 22 disengaging with the third damper plate 23. When the water reaches to a lower level, the transverse portion 234 of the third damper plate 23 will be pressed by both the first and second damper plates 21 and 22 moving downward to force the first shoulder 231 of the third damper plate 23 to disengage with the rigid flap means 12 so as to set the outlet valve 11 free to close the water outlet 14 on its own weight. While, the water begins to recuite into the tank 1 (as shown in FIG. 15).

Figure 16:
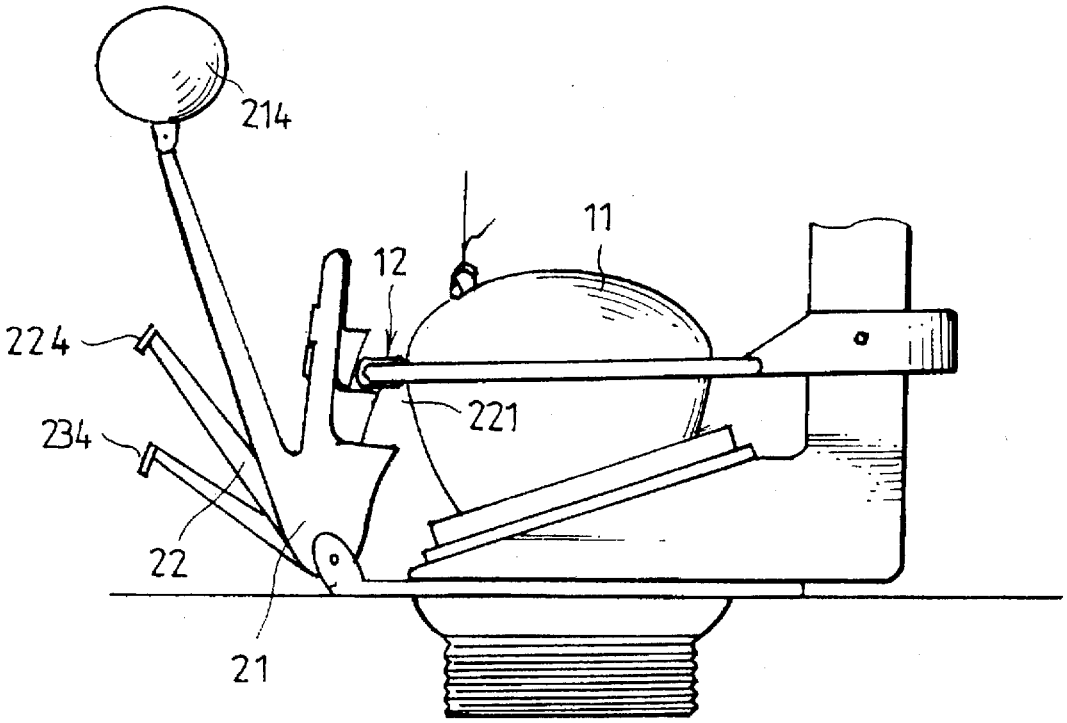
FIG. 16 is a perspective view to show the three stepped flush control device discharging a medium amount of the flush water.

If one intends to discharge a medium amount of flush water (as shown in FIG. 16), it is to open the outlet valve 11 to a span 72 equal to the height b and the first damper plate 21 under the buoyancy of the float ball 214 will move the first shoulder 221 of the second damper plate 22 forward to engage with the under side of the rigid flap means 12. The other steps of this mode will be processed as recited in the above instance.

Figure 17:
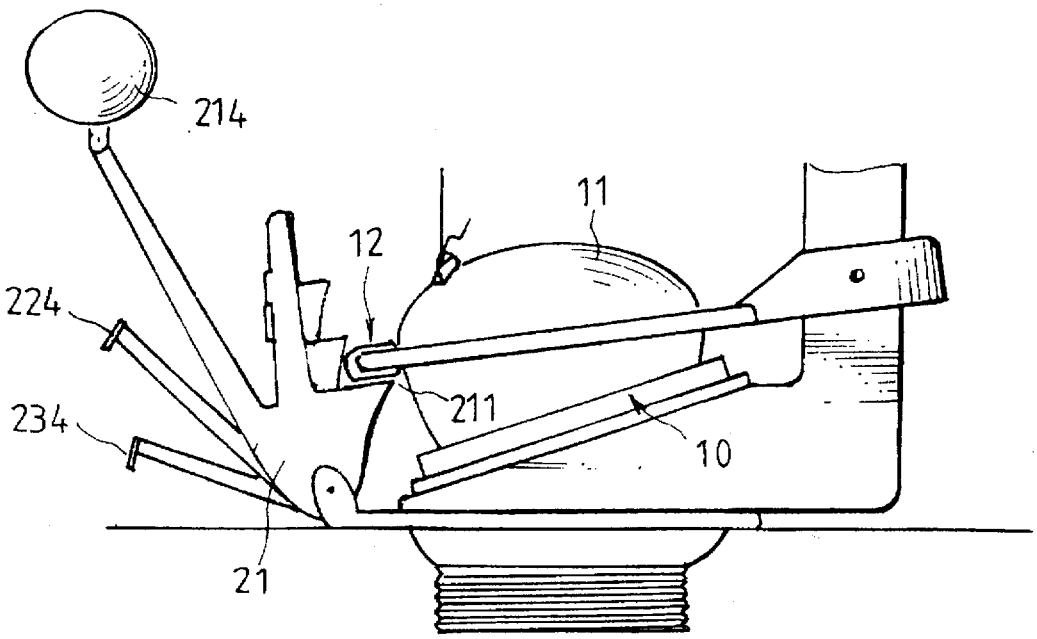
FIG. 17 is a perspective view to show the flush water device of FIG. 14 discharging a minimum amount of flush water.

If wants to discharge a minimum amount of flush water (as shown in FIG. 17), the outlet valve 11 is opened to a span 71 equal to the height a and the first shoulder 211 of the first damper plate 21 will engage with the underside of the rigid flap means 12 under the buoyancy of the float ball 214. The other steps are processed as recited in the above instance and is not worth to repeat again.

Referring to FIG. 18, another operation mode is shown in which an alternative first and second damper plates 21' and 22' is adapted together with a two stepped control member 30. The second shoulders 215 and 225 and the transverse portion 224 are omitted in this example. At the free ends of the tails 212' and 222' of the damper plates 21' and 22' are respectively pivoted a float ball 214' and 224'. When the water in the tank 1 is at a high level, the float balls 214' and 224' under sufficient buoyancy actuate the damper plates 21' and 22' to move forward to have their first shoulders stopped against the top of the rigid flap means 12 so as the outlet valve 11 is at a closed position.

If wants to discharge a large amount of flush water, first rotate the control member 30' to shift the positioning rod 62 in the stopping rod 64 so as to lift the outlet valve 11 opening to a span 72 equal to the height b and the damper plates 21' and 22' will be moved more forward by the float balls 214' and 224' to have the first shoulder 221' of the second damper plate 22' engaged with the under side of the rigid flap means 12 to permit a smooth discharge of a large amount of flush water from the tank 1. When the water in the tank 1 went down to a certain level, the first damper plate 21' actuated by the float ball 214' will first move backward to leave from the outlet 14. When the water went down to a lower level, the second damper plate 22' actuated by the float ball 224' also moves backward to disengage the first shoulder 221' thereof with the rigid flap means 12 to permit the outlet valve 11 dropping down to close the water outlet 14 on its own weight and begins the recruitment of water into the tank 1.

If want to discharge a small amount of flush water, shift the positioning rod 61 of the control member 30' to the stopping rod 64 so as to lift the outlet valve 11 opening to a span 71 equal to the height a, and the first shoulder 211' of the first damper plate 21' will automatically move forward to engage with the under side of the rigid flap seans 12 to permit a smooth discharge of a small amount of flush water. The second damper plate 22' will be moved in accordance with the variations of the water level but will not disturb the activity of the first damper plate 21'. When the water in the tank 1 reached to a certain downward level, the first damper plate 21' under the downward movement of the float ball 214' will automatically move away from the outlet valve 11 to disengage the first shoulder 211' thereof with the rigid flap means 12, so that the outlet valve 11 closes the water outlet 14 on its own weight and the water pressure, therefore obtaining a discharge of small amount of flush water.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A control device for discharging selective flush water comprising:

a water discharging member, a control member and a stepped check member, wherein:

said water discharging member comprising a water outlet adapted to be positioned in a bottom of a water tank and an outlet valve positioned on the top of said water outlet and adapted to be pivotally engaged with an overflow pipe;

said control member adapted to be pivotally secured to a upper portion of said water tank and in alignment with said water discharging member and comprising a shaft, a plurality of positioning rods on said shaft and a stopping means spacedly extended outward from a circumferential edge of said shaft, and a connecting means having at one end attached to said shaft and the other end connected to said outlet valve;

said stepped check member comprising a plurality of damper plates of different sizes, each plate having a first shoulder wherein said shoulders are of differing heights and located at a front side thereof and facing toward said water discharging member and an axial hole laterally formed adjacent a lower end thereof for co-axially and pivotally engaging said damper plates onto a lug means adjacent said outlet valve; said damper plates each having an elongate tail wherein said tails are of differing heights and including an extension thereof corresponding to different water levels in said water tank, a float ball pivoted to a free end of the elongate tail of one of said damper plates, a transverse portion formed at a free end of the elongate tail of another said damper plates, and a second shoulder formed on a rear side of said one of said damper plates.

2. A control device as recited in claim 1 wherein said shaft is adapted to be pivotally attached to an upper portion of said water tank and in alignment with said water discharging member said positioning rods being of different lengths and rotatably secured to a periphery adjacent one end of said shaft, said stopping rod being perpendicular to said a longest positioning rod and a suspension means having at one end secured to the other end of said shaft and the other end thereof connected with said outlet valve via a soft wire.

3. A control device as recited in claim 1 wherein said plurality of damper plates are arranged in a mackerel sky form.

4. A control device as recited in claim 1 wherein said outlet valve has a rigid flap means reinforced at a circumferential edge.

5. A control device as recited in claim 1 wherein said positioning rods of said control member define three intervals of different lengths with said stopping means, said each interval defining a length which equals a respective height of the first shoulders of said damper plates.

6. A control device as recited in claim 1 having three damping plates said highest elongate tail is on a same damper plate as a lowest first shoulder, said medium elongate tail is on a same damper plate as a medium height first shoulder and said lowest elongate tail is on a same damper plate as a highest first shoulder.

7. A control device as recited in claim 1 wherein said stepped check member comprises only first and second damper plates, said float ball pivoted to a free end of the elongate tail of said first damper plate and said transverse portion is at a free end of the elongate tail of said second damper plate.

8. A control device as recited in claim 1 wherein said stepped check member comprises first and second damper plates, and a second float ball pivoted at a free end of the elongate tail of said another of said damper plates.

* * * * *